US005540136A

United States Patent [19]

Noord

[11] Patent Number: 5,540,136

[45] Date of Patent: Jul. 30, 1996

[54] RECIPROCATING PISTON MOTOR OPERATING ON PRESSURE MEDIUM

[76] Inventor: Jan Noord, Asserstraat 115A, NL-9492 TA Ubbena, Netherlands

[21] Appl. No.: 395,375

[22] Filed: Feb. 21, 1995

[30] Foreign Application Priority Data

Feb. 23, 1994 [NL] Netherlands ..... 9400281

[51] Int. Cl.[6] ..... F01L 15/12

[52] U.S. Cl. ..... 91/224; 91/229; 91/228; 417/398

[58] Field of Search ..... 91/222, 422, 224, 91/229, 228; 417/397, 398

[56] References Cited

U.S. PATENT DOCUMENTS

| | | | |
|---|---|---|---|
| 806,779 | 12/1905 | Coffield | 91/228 |
| 858,226 | 6/1907 | Shevlin | 91/228 |
| 955,501 | 4/1910 | Coffield | 91/229 |
| 2,748,751 | 6/1956 | Johnson | 91/229 |
| 2,862,478 | 12/1958 | Staats . | |
| 3,361,036 | 1/1968 | Harvey et al. | 92/130 R |
| 3,583,839 | 6/1971 | Lee, III | 417/397 |

FOREIGN PATENT DOCUMENTS

| | | | |
|---|---|---|---|
| 2050379 | 7/1969 | France . | |
| 7704 | 10/1879 | Germany | 91/228 |
| 879338 | 4/1953 | Germany | 91/229 |
| 949 | of 1856 | United Kingdom | 91/229 |
| 1144268 | 3/1969 | United Kingdom . | |

*Primary Examiner*—Thomas E. Denion

*Attorney, Agent, or Firm*—Webb Ziesenheim Bruening Logsdon Orkin & Hanson, P.C.

[57] ABSTRACT

The invention relates to a reciprocating piston motor. The motor comprises at least one cylinder which is closed on at least one end, a piston which is slidable in the cylinder and forms a pressure chamber with the closed end of the cylinder, a power transmission element such as a piston rod coupled to the piston and extending outside the cylinder. The reciprocating piston motor likewise comprises a first valve member which is received in the piston and which in its open position mutually connects the cylinder spaces on either side of the piston, a second valve member which is received in the piston and which in its open position connects a pressure medium passage formed in the piston to a cylinder space on one side of the piston, a resilient member urging the piston in the direction of the closed cylinder end, actuating means which are connected to the valve members and embodied such that on contact with a stop in the pressure chamber the first valve member is closed and the second is opened and on contact with a stop on the opposite end of the cylinder vice versa.

17 Claims, 3 Drawing Sheets

RECIPROCATING PISTON MOTOR OPERATING ON PRESSURE MEDIUM

BACKGROUND OF THE INVENTION

1. Field of the Invention

The invention relates to a reciprocating piston motor which operates on a pressure medium such as compressed air.

2. Description of the Prior Art

Such reciprocating piston motors are for instance used to drive hydraulic plunger pumps. In known embodiments, servo valves mounted on the outside against the cylinder are usually applied for feed and discharge of the compressed air. The servo valves are controlled by control valves which are actuated by the piston in the respective end positions thereof.

SUMMARY OF THE INVENTION

The invention now has for its object to provide a reciprocating piston motor of the stated type which is simpler in construction and can thereby be manufactured at a lower cost price. This objective is achieved with the reciprocating piston motor claimed in claim 1.

Because the valve members are incorporated in the piston itself and are actuated directly by the actuating means which come into contact with the stops at either end of the stroke of the piston, the piston motor according to the invention can be manufactured with very few components and at comparatively low cost.

A suitable embodiment of the piston motor according to the invention which is particularly suitable for driving a high-pressure plunger pump is claimed in claim 2. In this application the cylinder can be embodied simply in closed form at the end opposite the pressure chamber, and by connecting the pressure chamber directly to the supply connection for the pressure medium the design steps for sealing the pressure medium passage are minimal.

The pressure medium passage in the piston can be connected externally to a pressure medium feed or discharge via for instance a passage in the power transmission element such as a piston rod or pump plunger.

A favourable further development is however claimed in claim 3. The connections hereby become very short and cause no sealing problems.

The number of components of the piston motor according to the invention can be further limited by applying the step of claim 4.

A further limiting of the number of components is achieved with the step of claim 5. When this step is applied only one separate part, the valve member, is required to control the reciprocating movement of the piston.

A favourable further development is claimed in claim 6. Hereby achieved is that the valve member snaps from the one position into the other. The valve member hereby always lies in reliable manner in one of the two positions so that reliable switching is obtained.

BRIEF DESCRIPTION OF THE DRAWINGS

The invention is further elucidated in the following description with reference to the annexed figures.

DESCRIPTION OF THE PREFERRED EMBODIMENTS

Figure 1:
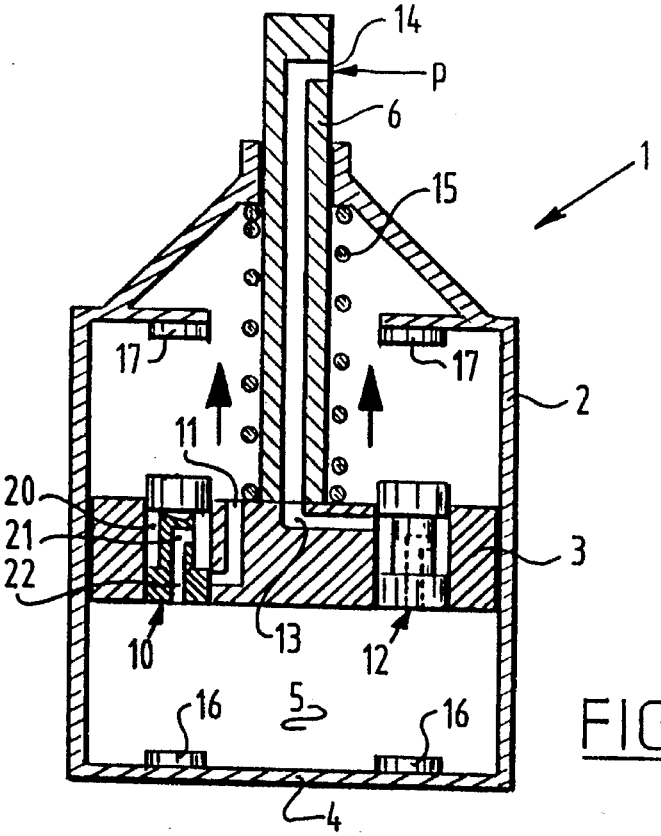
FIG. 1 shows schematically a single-cylinder piston motor according to the invention during the working stroke.

The motor shown in FIG. 1 comprises a cylinder 2 which is closed at the lower end 4. A piston 3 is slidable in cylinder 2. Defined between piston 3 and the closed end 4 is a pressure chamber 5 into which pressure medium can be fed in a manner to be described further in order to press the piston 3 upward in a working stroke. Connected to piston 3 is a piston rod 6 which extends outside the cylinder 2 and using which the desired work can be supplied.

Figure 2:
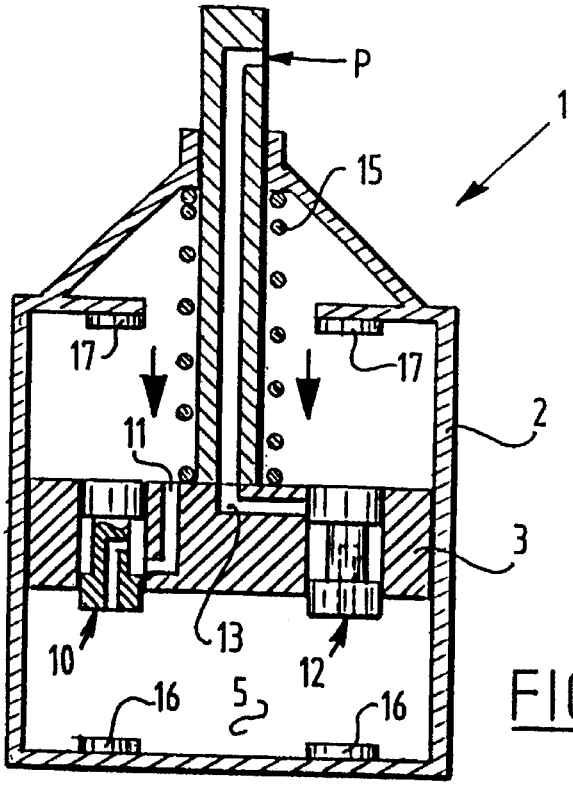
FIG. 2 shows the piston motor of FIG. 1 during the return stroke.

Received in piston 3 is a first valve member 10 which is embodied in the schematic view of FIGS. 1 and 2 as a cylindrical element which is axially slidable in a cylindrical bore in the piston 3. The cylindrical element has a groove 20 in the middle. The chamber formed by this groove 20 communicates via a transverse bore 21 and a longitudinal bore 22 with pressure chamber 5. The first valve member is drawn in FIG. 1 in the closed position and in FIG. 2 in the opened position. In the open position of FIG. 2 a bypass line 11 joins the cylinder spaces on either side of piston 3 via the bores 21 and 22 in the valve body.

The second valve member 12 takes a form identical to the first valve member 10. In the open position drawn in FIG. 1 this second valve member 12 can connect a pressure medium passage 13 formed in piston 3 to the pressure chamber 5 via the bores in the associated valve body. The pressure medium passage 13 communicates via an axial passage in the piston rod with a connection 14 for pressure medium such as compressed air.

The motor 1 further comprises a spring 15 which is arranged round the piston rod 6 and which supports on one side against the piston 3 and on the other side against a part of the motor fixedly connected to the cylinder 2. The spring 15 thus urges piston 3 in the direction toward the closed cylinder end 4.

As will be seen from comparing FIGS. 1 and 2, the first and second valve members 10 and 12 are received slidably in the cylinder 3. The protruding ends of the valve bodies form actuating means which can co-act respectively with stops 16 in pressure chamber 5 and stops 17 at the opposite end of cylinder 2.

The operation of the motor 1 is as follows.

In the position of the first and second valve members 10 and 12 shown in FIG. 1, pressure medium flows via connection 14 and pressure medium passage 13 in the piston 3 and via the second valve member 12 to the pressure chamber 5. The pressure medium in pressure chamber 5 presses the piston 3 upward counter to the force of the spring 15 and a driven apparatus optionally connected to piston rod 6.

As soon as piston 3 has been moved so far upward in cylinder 2 that the protruding parts of valve members 10, 12, which form the actuating means thereof, come into contact with the stops 17, the valve members 10, 12 are moved from the position shown in FIG. 1 to the position shown in FIG. 2. Herein the first valve member 10 is thus opened and the second valve member 12 closed. Because the second valve member 12 is closed, no more fresh pressure medium is supplied to the pressure chamber 5. Because the first valve member 10 is opened, pressure medium can flow out of the pressure chamber 5 via the bypass line 11 to the space above piston 3, so that a pressure equalization can occur between the cylinder spaces on either side of piston 3. As a result of the force exerted on piston 3 by spring 15 the piston moves downward.

As soon as piston 3 has been moved so far downward that the parts of the first and second valve members 10 and 12 protruding below piston 3, which form the actuating means therefor, come into contact with the stops 16, the valves 10, 12 are re-placed into the position shown in FIG. 1. The bypass line 11 is hereby closed and the pressure medium passage 13 opened so that pressure medium can once again flow out of pressure chamber 5 and the piston can again move upward.

The piston 3 thus moves with piston rod 6 continuously in reciprocal manner, wherein an apparatus connected to piston rod 6 can be driven.

Figure 3:
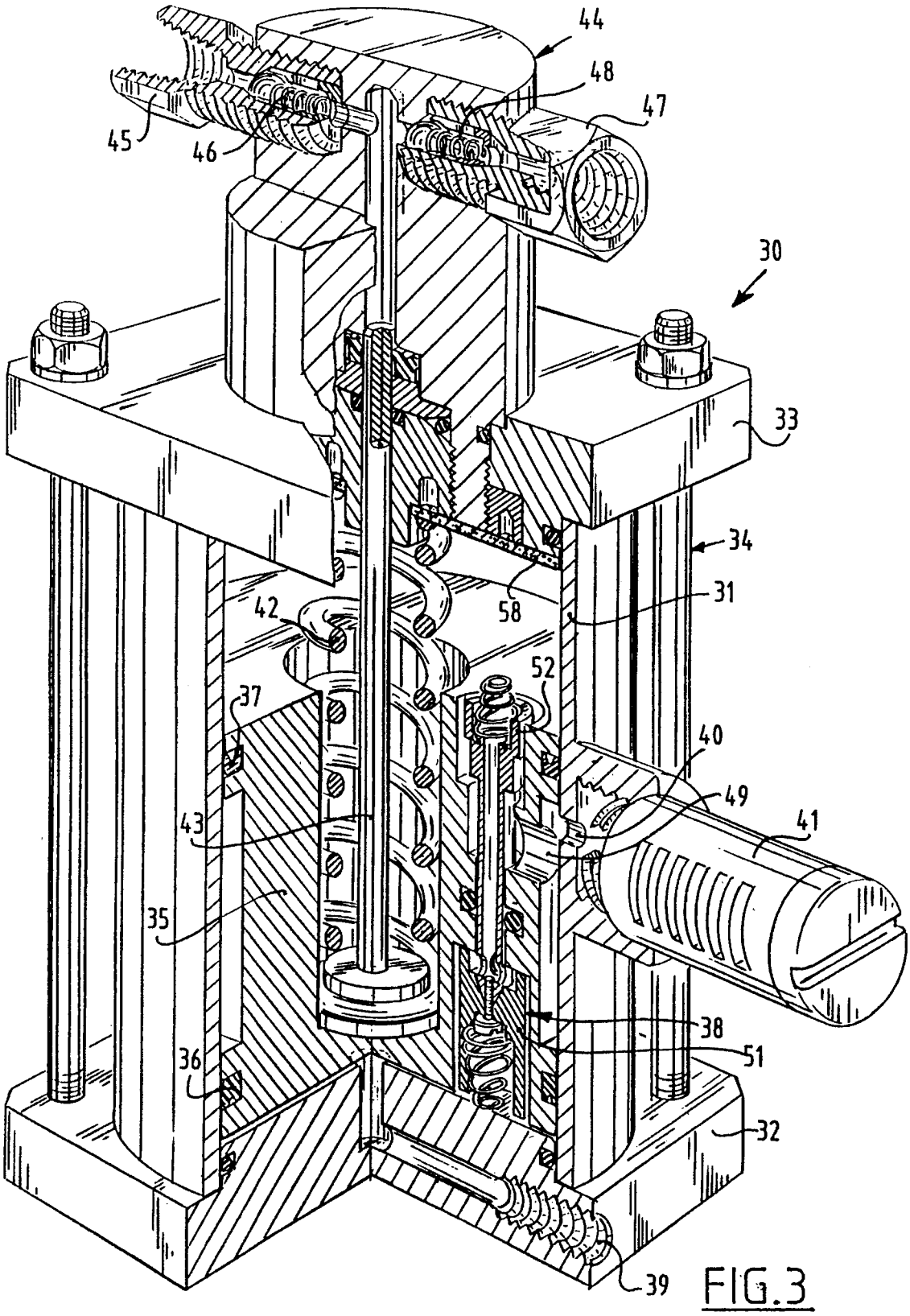
FIG. 3 is a partly sectional perspective view of a piston motor according to a preferred embodiment of the invention.

The motor 30 shown in FIG. 3 is a further developed embodiment. Motor 30 is likewise a single-cylinder motor, the cylinder 31 of which is closed with respectively a bottom cover 32 and a top cover 33. The covers 32, 33 are tensioned towards each other in per se known manner by means of four tensioning bolts 34 while clamping the cylinder bushing 31.

A piston 35 is received slidably in cylinder 31. The thickness of piston 35 is greater than the stroke which the piston 35 can travel in cylinder 31.

Close to its opposing ends the piston is sealed in the cylinder by means of seals 36 and 37, wherein piston 35 has acquired a slightly smaller outer diameter between these seals 36, 37. Midway along the height of cylinder 31 a pressure medium outlet aperture 40 is arranged in the wall of cylinder 31. Due to the described thickness of piston 35 this outlet aperture 40 remains just within the seals 36, 37 in the extreme positions of piston 35 and communicates with the annular chamber formed by the smaller diameter.

The valves corresponding to the first and second valve members 10, 12 of motor 1 are mutually combined in motor 30 to an integral unit valve 38. The lower part 51 forms the first valve member which, in its open position, mutually connects the cylinder spaces on either side of piston 35, and the upper end of valve body 38 forms the second valve member 52 which, in its open position, connects a pressure medium passage 49 to the cylinder space above piston 35. In the case of motor 30 also the pressure chamber is formed on the underside of the cylinder 35.

Arranged in the bottom cover 32 is a pressure medium connection 39, in particular a compressed air connection, which debouches into the pressure chamber below piston 35. In the drawn position of the valve 38 corresponding with FIG. 4, the operation of which valve will otherwise be further elucidated with reference to FIGS. 4 and 5, the bypass connection between the opposite sides of piston 35 is closed so that the piston 35 is pressed upward by the pressure medium supplied via the connection 39. Pressure medium is simultaneously drained from the cylinder space above piston 35 via the pressure medium passage and the outlet 40. Since compressed air is used in this embodiment, the outlet 40 can debouch directly into the environment, albeit via an outlet silencer 41.

When the piston 35 moves upward a plunger 43 is pressed upward. This plunger 43 is a plunger of a high-pressure pump 44. This latter has an inlet 47 with a suction valve 48 and opposite this an outlet 45 with a delivery valve 46. When the plunger 43 moves downward medium such as a liquid is drawn into the plunger space and during the upward stroke this medium is pressed outward through the outlet 45.

The return stroke of piston 35 with plunger 43 takes place under influence of the helical compression spring 42.

Figure 4:
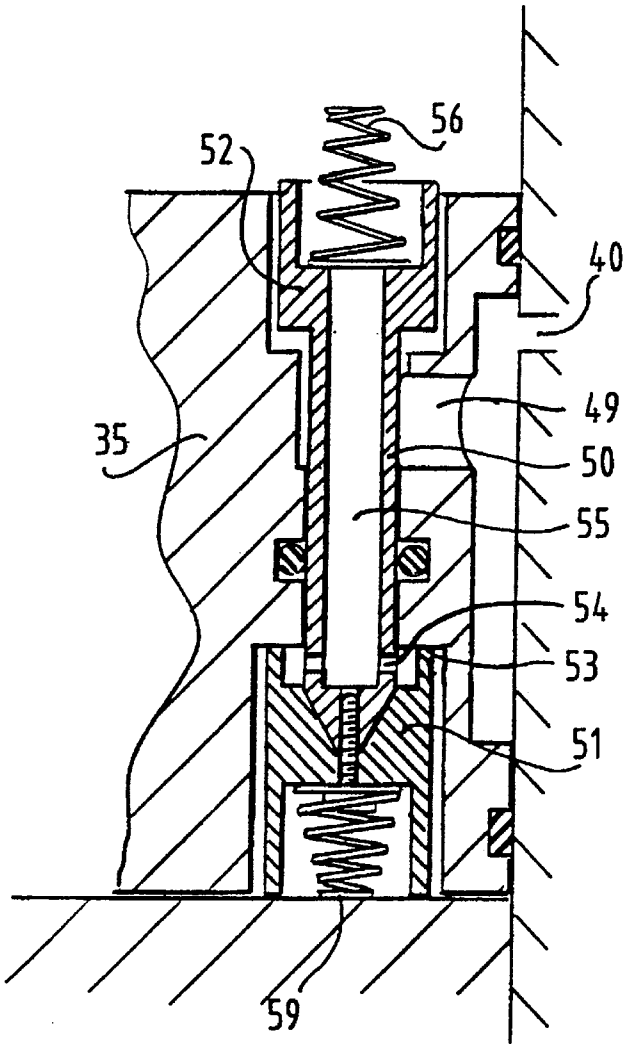

As noted, the valve 38 is shown in FIG. 4 in the situation as also drawn in FIG. 3. The valve 38 comprises a valve body 50 in which the said first valve member 51 and the second valve member 52 are combined. The first valve member 51 has an axial sealing face 53. In the valve body 50 is arranged an axial bore 55 which debouches close to the sealing face 53 via transverse bores 54. In the closed position of the first valve member 51 there is thus no connection between the cylinder spaces on either side of piston 35.

Figure 5:
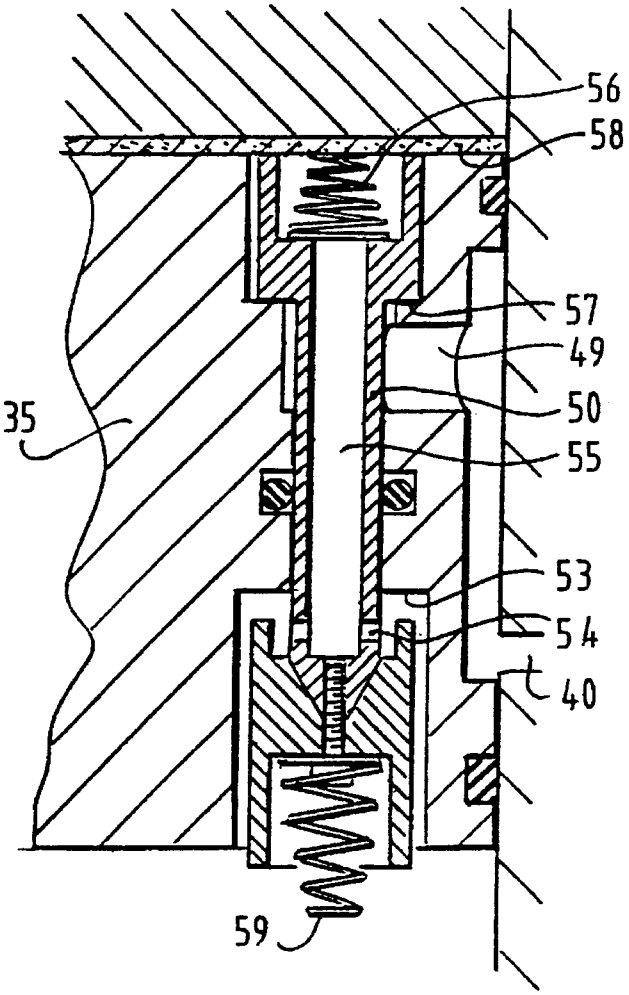
FIGS. 4 and 5 show the valve of the motor of FIG. 3 in two respective operational positions.

In the opened position of the first valve member 51 as shown in FIG. 5, there is this open connection.

The second valve member 52 is in the open position in FIG. 4. In this open position this second valve member provides a connection between the cylinder space above piston 35 and the pressure medium passage 59 in piston 35. Via this pressure medium passage 49 pressure medium can flow from the cylinder space above piston 35 to the outlet 40.

During the working stroke, wherein the piston 35 is pressed upward, the medium situated above piston 35 can thus be displaced via this passage 49 and the outlet 40.

During this working stroke the valve body 50 is held in the position drawn in FIG. 4 because the compressed air pressure acting on the underside of piston 35 acts on the large diameter of the axial sealing face 53 and the lower outside air pressure on the smaller diameter. There is therefore an upward resultant pressure which holds the valve body 50 closed.

As soon as the piston 35 now reaches the end of its working stroke a spring 56 accommodated in the top of the valve body 50 comes into contact with the upper wall of the cylinder. Arranged in the cylinder space is a disc 58 of damping material which damps the stroke of piston 35 against the upper wall of the cylinder in order to limit the noise level and prolong the lifespan of the piston.

During the further upward movement the spring 56 is tensioned so that a downward bias on the valve body 50 is created. As soon as piston 35 has moved so far upward that the upper edge of valve body 50 comes into contact with the disc 58, the valve body 50 is pressed downward relative to piston 35, whereby the contact at the position of the sealing face 53 is broken. The upper end of valve body 50 seals against disc 58 so that the pressure prevailing under piston 35 can be transmitted directly into the bore 55. The above mentioned upward resultant force consequent upon the pressure differences is removed, whereafter the valve body 50 moves in stroke-wise manner into the position of FIG. 5 as a result of the force built up in spring 56.

In this position the sealing face 57 of the second valve member 52 is closed, whereby the connection between the upper cylinder space and the outlet is broken and the connection between the cylinder space on either side of piston 35 is opened via bores 54 and 55. Pressure medium from below the piston can flow upward through this latter connection so that a pressure equilibrium can be adjusted. The spring 42 then presses piston 35 downward, wherein pressure medium thus flows out of the pressure chamber to the cylinder space above piston 35. The outside air pressure acts via the outlet 40 on the small diameter of the axial sealing face 57. The pressure of the compressed air supplied via connection 39 thus acts on the large diameter. The valve body 50 is hereby held with a positive downward force in the position of FIG. 5.

At the end of the downward stroke the spring 59 first comes into contact again with the bottom of the cylinder and is tensioned. As soon as the lower edge of the valve body 50 comes into contact with the cylinder bottom the contact at the position of the sealing face 57 is broken, whereby air will begin to flow along this sealing face 57 to the outlet 40. The pressure difference over the sealing face 57 hereby becomes smaller, whereby the downward positive force on valve body 50 decreases and the force accumulated in spring 59 can thus with certainty press the valve body 50 upward. With further opening of the sealing face 57 the pressure difference thereover decreases, whereby valve body 50 moves fully upward until the sealing face 53 closes again. The compressed air pressure then acts again on the large diameter of sealing face 57 and the lower pressure in the cylinder space above piston 35 acts on the small diameter thereof, whereby a positive holding force in upward direction results.

It will be apparent from the above that at each switch-over the valve body 50 snaps in stroke-like manner from the one position into the other and can thus not remain hanging. The intended switching action is hereby obtained with certainty and the valve, and thereby the piston, are prevented from beginning to oscillate at the end of a stroke.

The reciprocating piston motor according to the invention can be used for many applications. As described, compressed air can be used as pressure medium, although other gases under pressure, such as gases from pressure cylinders, can also be used as pressure medium. The piston motor according to the invention can also be used with a liquid under pressure as pressure medium, wherein the dimensions of the valve members will be adapted to the properties of the liquid, such as in particular the viscosity thereof.

In addition to use as drive motor for a plunger pump, for which purpose the piston motor according to the invention is particularly suitable, many other applications are possible. The reciprocating movement can be used directly as driving movement, for instance in a vibrating screen, a pile-driver, a sawing machine and the like, as well as a rotating movement converted by for instance a crank-connecting rod mechanism. As a result of the limited to very limited number of components from which it can be manufactured, a piston motor according to the invention has a very extensive field of application.

What is claimed is:

1. A reciprocating piston motor comprising at least one cylinder which is closed on at least one end, a piston which is slidable in the cylinder and forms a pressure chamber with the closed end of the cylinder, a stop in the pressure chamber, a stop on an opposite end of the cylinder, a power transmission element coupled to the piston and extending outside the cylinder, a first valve member which is received in the piston and which in an open position mutually connects the cylinder spaces on either side of the piston, a second valve member which is received in the piston and which in an open position connects a pressure medium passage formed in the piston to a cylinder space on one side of the piston, a resilient member urging the piston in the direction of the closed end of the cylinder, actuating means which are connected to the valve members and which are embodied such that on contact with the stop in the pressure chamber, the first valve member is closed and the second valve member is opened and on contact with the stop on the opposite end of the cylinder the first valve member is opened and the second valve member is closed.

2. The piston motor as claimed in claim 1, wherein a supply connection for pressure medium is in continuous connection with the pressure chamber and the cylinder is closed at the opposite end.

3. The piston motor as claimed in claim 1, wherein the cylinder includes a wall, wherein the piston is reciprocally movable through a determined stroke, a thickness of the piston is greater than the stroke, the piston is sealed in the cylinder close to both ends and wherein at a position of the centre of the piston, midway along the stroke, a connection joined to the pressure medium passage in the piston is arranged in the cylinder wall.

4. The piston motor as claimed in claim 1, wherein the first and the second valve members are integrally joined to each other.

5. The piston motor as claimed in claim 4, wherein the valve members extend axially in the piston and the actuating means is formed by parts of the valve members.

6. The piston motor as claimed in claim 4, wherein the actuating means comes via pressure springs into contact with the stops, the valve members are provided with axial sealing faces and are arranged such that in a closed position a higher pressure of the pressure medium acts on the side of a larger diameter of the sealing face.

7. The piston motor as claimed in claim 1, wherein the power transmission element is a plunger of a high-pressure plunger pump connected to the cylinder, which plunger is coaxial to the piston.

8. The piston motor as claimed in claim 1, wherein the transmission element is a piston rod.

9. The piston motor as claimed in claim 2, wherein the cylinder includes a wall, wherein the piston is reciprocally movable through a determined stroke, a thickness of the piston is greater than the stroke, the piston is sealed in the cylinder close to both ends and wherein at a position of the centre of the piston, midway along the stroke, a connection joined to the pressure medium passage in the piston is arranged in the cylinder wall.

10. The piston motor as claimed in claim 2, wherein the first and the second valve members are integrally joined to each other.

11. The piston motor as claimed in claim 3, wherein the first and the second valve members are integrally joined to each other.

12. The piston motor as claimed in claim 5, wherein the actuating means comes via pressure springs into contact with the stops, the valve members are provided with axial sealing faces and are arranged such that in a closed position a higher pressure of the pressure medium acts on a side of the larger diameter of the sealing face.

13. The piston motor as claimed in claim 2, wherein the power transmission element is a plunger of a high-pressure plunger pump connected to the cylinder, which plunger is coaxial to the piston.

14. The piston motor as claimed in claim 3, wherein the power transmission element is a plunger of a high-pressure plunger pump connected to the cylinder, which plunger is coaxial to the piston.

15. The piston motor as claimed in claim 4, wherein the power transmission element is a plunger of a high-pressure plunger pump connected to the cylinder, which plunger is coaxial to the piston.

16. The piston motor as claimed in claim 5, wherein the power transmission element is a plunger of a high-pressure plunger pump connected to the cylinder, which plunger is coaxial to the piston.

17. The piston motor as claimed in claim 6, wherein the power transmission element is a plunger of a high-pressure plunger pump connected to the cylinder, which plunger is coaxial to the piston.

* * * * *